US006604482B1

(12) United States Patent
Martello

(10) Patent No.: US 6,604,482 B1
(45) Date of Patent: Aug. 12, 2003

(54) HANGER FOR SECURING A LINE TO A CLEAT

(76) Inventor: Gilbert A. Martello, 2900 Rockefeller Rd., Willoughby, OH (US) 44092

( * ) Notice: Subject to any disclaimer, the term of this patent is extended or adjusted under 35 U.S.C. 154(b) by 0 days.

(21) Appl. No.: 10/039,000

(22) Filed: Jan. 4, 2002

Related U.S. Application Data

(60) Provisional application No. 60/260,009, filed on Jan. 5, 2001.

(51) Int. Cl.[7] ..... B63B 21/04
(52) U.S. Cl. ..... 114/218; 114/219
(58) Field of Search ..... 114/218, 219

(56) References Cited

U.S. PATENT DOCUMENTS 3,473,505 A * 10/1969 Brown ..... 114/230.29
4,414,712 A * 11/1983 Beggins ..... 24/129 R
4,895,094 A * 1/1990 Carlstedt ..... 114/218
4,998,495 A * 3/1991 Bos et al. ..... 114/218
5,365,872 A * 11/1994 Obrinski ..... 114/230.24
5,493,983 A * 2/1996 Hurt ..... 114/364
6,094,783 A * 8/2000 Parsons ..... 24/130
6,223,670 B1 * 5/2001 Schulze ..... 114/218
6,330,949 B1 * 12/2001 DeRisio ..... 211/85.7

* cited by examiner

*Primary Examiner*—Stephen Avila
(74) *Attorney, Agent, or Firm*—Renner, Kenner, Greive, Bobak, Taylor & Weber

(57) ABSTRACT

A hanger for attaching an end of a line into a cleat having an opening, the hanger having a length, a width, and a thickness, wherein the thickness and width are such that they may pass through the opening defined by the cleat and the length is greater than that of the opening, and a receiver formed on a hanger for securing the end of the line to the hanger, whereby upon passing the hanger lengthwise through the opening, the hanger is rotated to bring the length to bear on the walls of the opening preventing the hanger from passing back through the opening.

30 Claims, 3 Drawing Sheets

HANGER FOR SECURING A LINE TO A CLEAT

This Application claims the benefit of Provisional Application Ser. No. 60/260,009 filed Jan. 5, 2001.

BACKGROUND OF THE INVENTION

In boating, lines are used for a variety of tasks including securing boats to a dock or to each other. To facilitate use of lines for these purposes, boats and docks are often provided with various members to which the line may be secured. The most common of these members is probably the cleat. Typically, a boat is provided with at least a pair of cleats at its fore and aft for securing the boat to a docking structure or other boat. The most common way of securing boats together or to a docking structure is to tie off the ends of a line to the respective cleats on the dock and boat. For this purpose, lines are often provided with loops at either end. These loops may be formed by the manufacturer or created by knotting each end of the line. Alternatively, the ends of each line may be tied to the cleat or wrapped in a lapping pattern around the cleat to hold the line fast. These tying or lapping procedures are often difficult to perform or unknown to amateur boaters. In poor weather conditions, such as heavy winds or storms, these procedures can be difficult for experienced boaters.

Another common use for lines is to hang fenders from the sides of the boat to prevent the boat from rubbing or impacting the sides of adjacent boats or docking structures. Ordinarily, fenders are hung over the side of the boat, but they are attached to the docking structure. As is well known, when a boat is docked, waves act against the boat driving it toward an adjacent boat or docking structure, while causing the boat to move vertically relative to these adjacent structures, potentially causing serious damage to the dock or the boat. The fenders are placed between the boat and the docking structure to act as a cushion and space the boat from the docking structure. To that end, elongated fenders that substantially extend downward the entire height of the boat extending above the surface of the water are hung periodically around the perimeter of the boat. These fenders are generally closed at each end forming a bladder that traps a pocket of air within the walls of the fender. The walls of the fender are typically made of rubber or other similar material capable of cyclically flexing and rebounding as the fender is compressed and released by the motion of the boat relative to the docking structure or adjacent boats. To facilitate attachment of the fender to the boat or docking structure, the fender typically has an integrally formed loop at one or both ends. Ordinarily, a rope, chain, or webbing, which for simplicity will be collectively referred to as a line, may be passed through or tied to the loop. The free end of the line is then typically used to secure the fender to the dock or boat.

Prior to the present invention, fenders were secured by tying the free end of the line to some member on the boat or dock. In most instances the free end was tied to a cleat. To secure the fender to the cleat the user had to pass the line through an opening within the cleat and tie the line in a knot. The tying of such a knot requires some skill or a fair amount of practice making it difficult and time consuming to secure the fender.

Adding to the difficulty of hanging these fenders, it may be necessary to secure them to the boat while the boat is in motion. Faced with the difficulty of untying the fender line, while the boat is in motion, some boaters simply leave the fenders hanging from the sides of the boat. Other boaters more commonly flip the fenders within the interior of the boat in an attempt to stow them. Depending on the location of suitable compartments for receiving the fenders, it may be necessary to untie the fender from the cleat to which it is secured before the fender can be properly stowed. In these instances, to properly stow the fender, the boater must untie the knot used to hang the fenders, and, then, upon returning to the dock, retie the fender to the side of the boat. It will be appreciated that while the boat is in operation or simply when the boat is pitching and rolling, this operation is difficult and somewhat time-consuming to perform with two hands. When particularly adverse conditions exist, such as storms, the generally two-handed process of tying a knot becomes extremely time consuming when one or both hands is intermittently needed to support or stabilize one's self.

Aside form the difficulties of securing the fender, tying the fender to a cleat on the boat or docking structure prevents one from tying a dock line. The line used to secure the fender often fills the space beneath the cleat's wings and occludes the central high of the cleat leaving no room for an additional line. Since the number of cleats on a boat or a docking structure is limited, boaters are often left with the choice of inadequately protecting their boat by using available cleats for the dock line only, or securing the fenders or dock line to less stable structures on the boat.

SUMMARY OF THE INVENTION

It is, therefore, an object of the present invention to provide a simpler mechanism for attaching an end of a line to a cleat.

It is a further object of the present invention to provide a mechanism for attaching the end of a line to a cleat such that the cleat may also be used to secure a dock line.

In light of at least one of these objects the present invention provides a hanger for securing a line to a cleat, which has a pair of sidewalls lying in a plane defining an eye therebetween, the hanger including a body portion attachable to the line having a length greater than the eye, and a nose extending from the body portion such that it protrudes into the plane of the sidewalls.

The invention further provides a hanger used to fasten a line to a cleat having spaced sidewalls separated by a distance, the line hanger including a body portion having a length greater than the distance between the sidewalls and a width less than the distance between the sidewalls, and a receiver carried on the body portion adapted to secure the line to the body portion, whereby the hanger is insertable lengthwise between the sidewalls and whereby the length of the body prevents passage of the body through the cleat in a widthwise manner.

The present invention further provides a buckle assembly used in conjunction with a line passing through an opening in a fender to attach the fender to a cleat, the buckle assembly including a buckle having a receiver adapted to adjustably receive the line, wherein the buckle is larger than the opening, whereby an end of the line extending from the buckle passes through the opening to hang the fender from the cleat, and a graspable tab extending from the buckle.

The present invention further provides a fender hanging assembly used in conjunction with a line and a cleat having sidewalls spaced by a distance, the fender hanging assembly including a hanger supported on the line on one side of the fender, the hanger including a body portion having a length greater than the distance and a width less than the distance, whereby the body portion is insertable between the sidewalls in a lengthwise fashion, and a buckle assembly supported on the line on the other side of the fender relative to the line hanger, the buckle assembly including a buckle adapted to prevent the fender from moving farther from the line hanger, and a tab extending from the buckle, whereby the tab is graspable to move the fender.

DETAILED DESCRIPTION

In the following detailed description of the preferred embodiments, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

For purposes of this description, a "line" includes any flexible member having a length including a rope, a string, a wire, webbing, plastic stripping, or a chain.

A traditional cleat encompasses a wooden, metal, or plastic fitting with two projecting horns around which a line may be made fast. The traditional cleat defines a central opening or eye beneath the horns. Traditional cleats may come in the form of retractable or so-called "pop-up" cleats that rest in a retracted position and may be manually extended, exposing the eye and sidewalls when their use is desired. Since the present invention interrelates with the sidewalls of the cleat, any pair of spaced sidewalls, such as those formed by a loop or a ring, a U-bracket attached to a surface, or a pair of rail supports are suitable, and, thus, for simplicity all of the above cleats and structures are collectively referred to as a "cleat" in the following description.

In similar fashion, an "eye" is an opening between spaced sidewalls.

Figure 3:
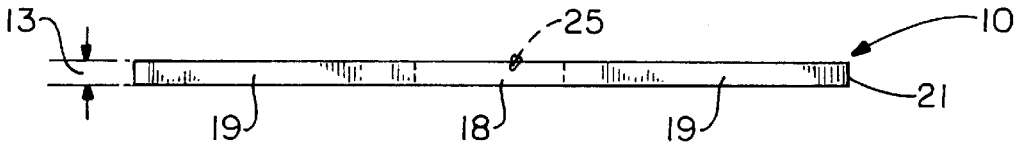
FIG. 3 is a front side elevational view of the hanger shown in FIG. 1.
Figure 4:
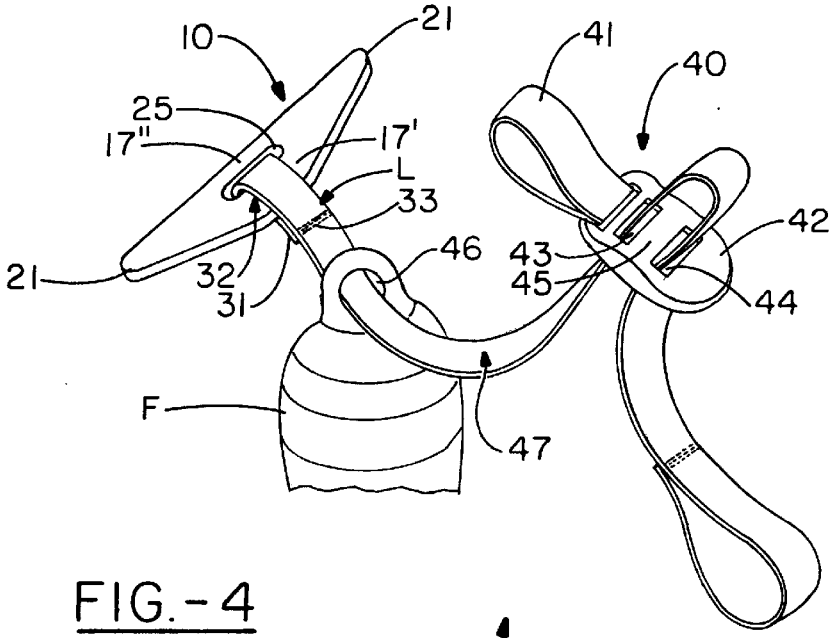
FIG. 4 is a partially fragmented perspective view depicting a hanger according to the present invention used to hang a fender from a cleat.
Figure 5:
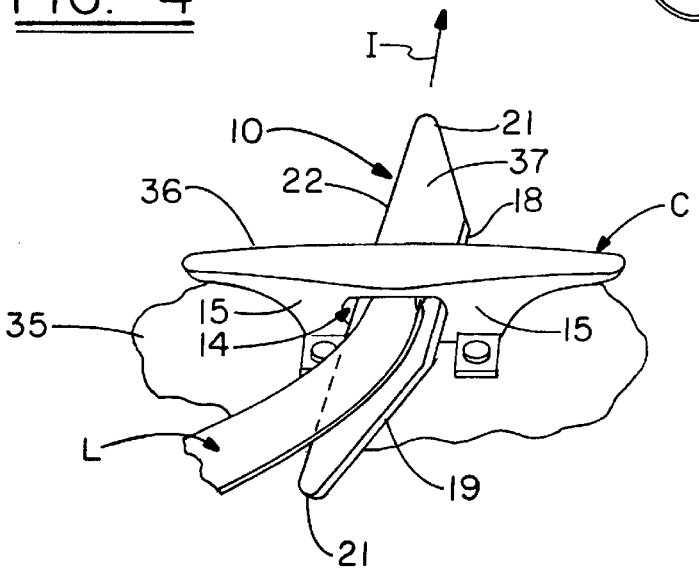
FIG. 5 is a partially fragmented perspective view of a hanger according to the present invention depicting insertion of the hanger and line through an eye of a cleat.

With reference to FIGS. 1–5, one embodiment of a line hanger according to the present invention is shown and generally indicated by the numeral 10. Hanger 10 may be a generally planar member, as shown, having a length 11 a width 12 and a thickness 13. As shown in FIG. 5, the width 12 is generally less than the spacing between sidewalls 15 of the cleat C, such that the hanger 10 may be passed lengthwise through the eye 14 between sidewalls 15. The length 11 of hanger 10 is generally larger than the spacing between sidewalls 15 such that once the hanger 10 is passed through the eye 14, it may be rotated to a secured position (FIG. 6), to prevent the hanger 10 from retracting through eye 14. Thus, it will be appreciated that, as long as these limitations are adhered to, the shape of the wing 10 is irrelevant to its proper function and thus, any form may be used to prevent the hanger 10 from retracting through the eye 14.

Figure 6:
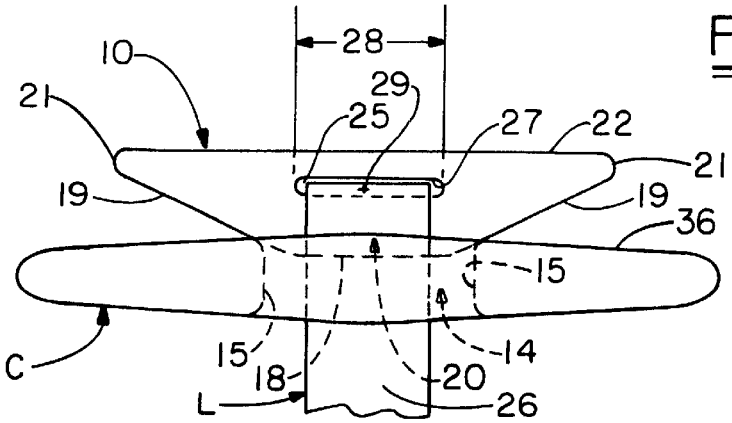
FIG. 6 is a partially fragmented perspective view of a hanger according to the present invention depicting a hanger in an attached position having a line attached thereto holding a fender.

To help reduce the likelihood of the hanger 10 becoming dislodged from its secured position (FIG. 6), the hanger 10 may be made to at least partially seat within the eye 14. To that end, hanger 10 may be provided with a nose 20 that at least partially projects into the plane of sidewalls 15, for example at a position laterally outward of sidewalls 15 or into eye 14, when the hanger 10 is in the secured position (FIG. 6). The nose 20 may be of any form that suitably projects as described and may include a downwardly extending member that creates a T-shaped hanger 10.

Figure 1:
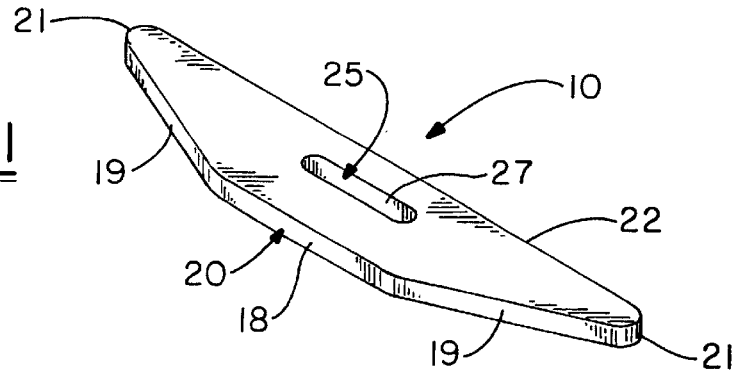
FIG. 1 is a perspective view of a hanger according to the present invention.
Figure 2:
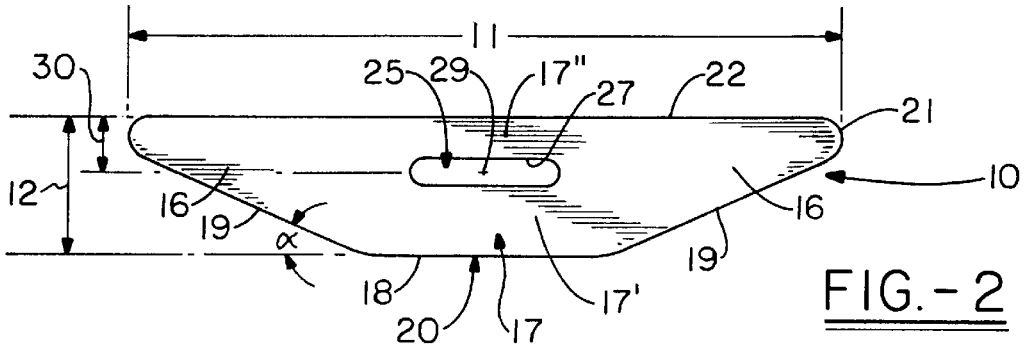
FIG. 2 is a top plan view of the hanger shown in FIG. 1.
Figure 2A:
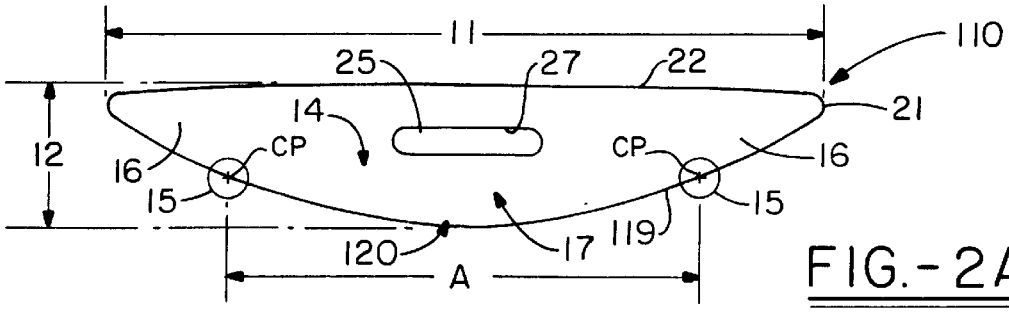
FIG. 2A is a top plan view of an alternative hanger.
Figure 3A:
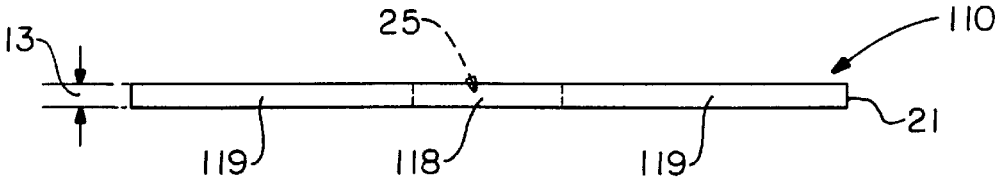
FIG. 3A is a front side elevational view of an alternative hanger.

In the embodiment shown in FIGS. 2 and 3, hanger 10 has a flattened nose 20 formed on a body portion 17 of hanger 10. The flattened nose 20 has an edge 18 formed generally parallel to the longitudinal axis of the hanger 10. The edge 18 is sized to fit within the eye 14 such that the nose 20 is at least partially seated therein (FIG. 6). Body portion 17 may include wing portions 16 extend rearwardly and outwardly from nose 20. In the example shown, wings 16 that extend outward and rearward from edge 18 respectively in the lengthwise and widthwise directions such that wing edges 19 are swept back from the body portion 17 of hanger 10. The wing edges 19 terminate in tips 21, 21 which are spanned at the rear of the hanger 10 by a trailing or second edge 22. As shown in FIG. 2, edges 18 and 22 may be substantially parallel to each other. Wing edges 19 extend rearwardly from first edge 18, at a generally acute angle $\alpha$ joining second edge 22 to form a hanger 10 having a generally truncated triangular shape. It will be appreciated that the edges 18, 19, and 22 of hanger 10 do not need to be planar, as shown, but may be curved, stepped, or include interrupting recesses. For example, as shown in the embodiment depicted in FIG. 2A, edges 18, 19 and 22 may be arcuate to form an elliptical hanger 10. One such hanger, generally indicated by the numeral 110, is shown as an example in FIGS. 2A and 3A with like parts on hanger 110, referred to by the same numerals as those used with hanger 10. As best shown in FIG. 2A, wing edges 119, and edge 118 may be joined to form a continuous arcuate heading surface (FIG. 3A). Nose 120 is arcuate and like the embodiment of FIG. 2 extends at least partially into the plane of sidewalls 15, in this case into eye 14, when in the secured position shown in FIG. 2A. As previously mentioned, great variation in the form of the hanger 10 may be made without departing from its inventive scope. It will be understood that the hangers 10, 110 shown in FIGS. 1–3A are interchangeable and for simplicity, further reference, to either embodiment, will be made with the numerals associated with hanger 10.

The dimensions of the hanger 10 are related to the dimensions of the cleat C and may be altered to accommodate cleats C of various size. For example, the dimensions of hanger 10 may be constructed relative to the distance A between side walls 15. To prevent retraction of the hanger 10, when its longitudinal axis is placed generally parallel to the plane joining the side walls 15, the length of the hanger 10 is made greater than distance A. In the example shown in FIG. 2, dimension A is approximately 70% of the length 11, or, in other words length 11 is about 140% of dimension A. As mentioned, the hanger 10 is shaped such that at least a portion of the nose 20 extends onto the plane of cleat C passing beyond the plane connecting the contact points CP on side walls 15 facing the hanger 10, such that the nose 20 seats within the eye 14 to an extent. This extension improves the ability of the hanger 10 to resist lateral motion in the secured position (FIG. 6). Any amount of extension is suitable. For example, nose 20 may extend at least 10% of distance A. In terms of the body portion's length 11, nose 20 may extend 10% of length 11. In the example shown in FIG. 2A, the nose 20 extends perpendicularly into the plane joining sidewalls 15 approximately 14% of the distance A. As will be appreciated increasing the degree of extension improves the reliability of the hanger's seating within the eye. The degree of extension is limited somewhat by the effect that such extension has on the overall width 12 of the hanger 10, as the hanger 10 must be inserted through the eye 14 of the cleat C. It will be appreciated that to maximize such extension, one may employ a recess in the rear surface 22 of the hanger 10 to maintain a suitable width 12, such as, for example creating a boomerang-shaped hanger 10. Similarly, while the hanger 10 may have a T-shape with wing portions 16 that have no slope. As mentioned, sweeping back i.e., sloping the wing portions 16 rearward of the plane connecting the contact points CP may also help to seat the nose 20 at least partially within the eye 14. In the example shown in FIG. 2, the wing portions 16 are swept back approximately 45 degrees. It may be seen that nose 20 has a lateral dimension, which is more easily seen as edge 18 in the embodiment shown in FIG. 2. This dimension may be of any size including a length of approximately 36% of the length 11 of body portion 12, as shown in FIG. 2 for purposes of illustration only.

Figure 7:
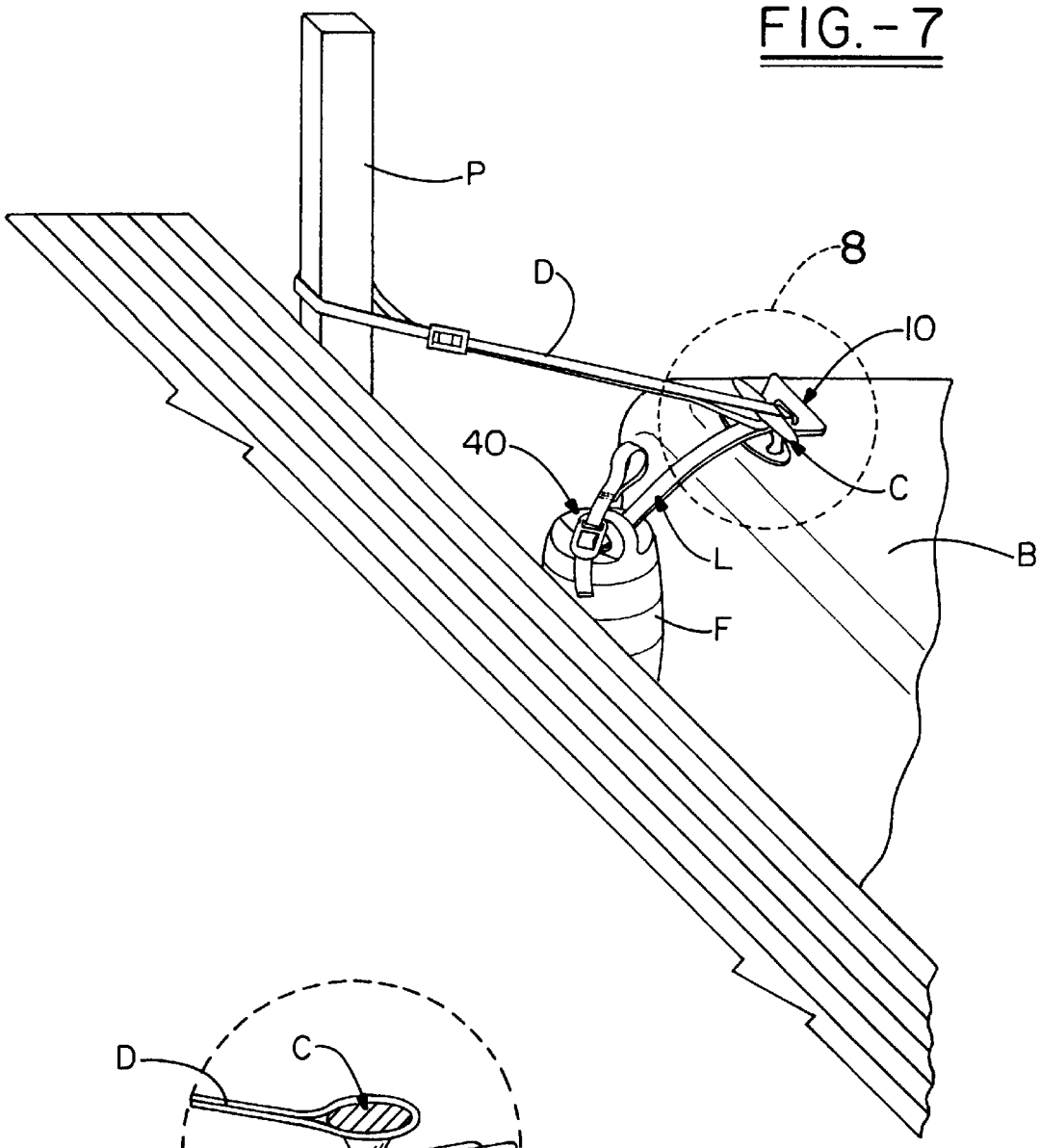
FIG. 7 is a partially fragmented perspective view depicting a fender attachment assembly according to the present invention including a buckle assembly and a hanger supported on a line passing through an opening in the fender, where the hanger is shown secured to a cleat on a boat, which in turn is shown secured to a dock by dock line tied to the cleat.
Figure 8:
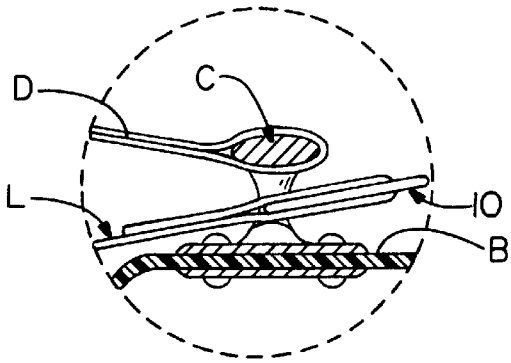
FIG. 8 is an enlarged view of the area circled in FIG. 7 depicting further details of securement of the hanger and dock line to the cleat.

As discussed, the width 12 of hanger 10 is generally less than the distance A between the side walls 15, such that the hanger 10 may be inserted lengthwise through the cleat C. For example, a hanger 10 having a width 12 of about 1.25 inches is suitable for a standard six inch or eight inch cleat C. While a six inch or eight inch cleat C is used as an example, it will be appreciated that the dimensions of the hanger 10 may be modified to accommodate different cleats C. For example, the length 11 of the hanger may be increased for cleats C having larger eyes 14, to ensure contact between the hanger 10 and sidewalls 15 of cleat C, when hanger D is in the secured position. The width 12, may be decreased to facilitate lengthwise insertion of the hanger 10 through smaller eyes 14. When the eye 14 is a closed opening, such as in a traditional cleat, the thickness 13 may be reduced for smaller eyes to provide clearance for the hanger 10. Similarly, thickness 13 may be adjusted to provide clearance for a separate dock line D attached to the same cleat C, such as when attaching a fender F and dock line L simultaneously to a cleat C, as shown in FIGS. 7–8.

For increased loads, the dimensions of the hanger 10 may be increased to accommodate the load, or reinforcing gussets may be incorporated at high stress points of the hanger 10. Alternatively, different materials may be used to handle the loads placed upon the hanger 10, during its operation. Suitable hanger materials include metal, wood, plastic, and other polymeric materials, and combinations thereof. When using materials that may scratch or otherwise mar the surfaces of the boat B or dock structure P with which the hanger 10 is associated, a suitable coating may be applied to hanger 10. Aside from the foregoing considerations, the hanger 10 may be shaped to provide greater comfort to the user or facilitate its use.

Hanger 10 is generally used in conjunction with a line L, which may be tied or otherwise attached to hanger 10. To facilitate attachment of line L to hanger 10, hanger 10 may be provided with at least one receiver, generally referred to by the numeral 25. Receiver 25 may be a clip, hook, loop, knob, or other structure to which the line L may be secured. Alternatively, receiver 25 may be an aperture formed within hanger 10, having a size and shape suitable for receiving line L. For example, when line L is a length of webbing 26, receiver 25 may take the form of a slot 27, as shown. Slot 27 may be oriented substantially parallel to the longitudinal axis of the hanger 10, or, as in the embodiment shown in FIG. 2, substantially parallel to a portion of the first or second edges 18, 22. To allow some movement of the line L on hanger 10, receiver 25 may be of slightly greater dimension than the line L received therein. For example, when receiving one inch nylon webbing, slot 27 may have a length 28 (FIG. 6) of about 1.125 inches. As with the dimensions of hanger 10, the dimension of receiver 25 may be adjusted to accommodate lines L of different sizes and shapes, or based on the loading conditions.

Receiver 25 may be located at any point on hanger 10 including the wing portions 16 or body portion 17, and at any relative location therein. For example, as best shown in FIG. 2, slot 27 may be formed in body portion 17. In this example, the center 29 of slot 27 is longitudinally centered and spaced relative to the second edge 22 by a distance such that, the slot 27 is off-center relative to the edges 18, 22 of body portion 17, defining a first portion 17' adjacent first edge 18, of body portion 17 that is wider than a second portion 17", adjacent second edge 22, of body portion 17. In the example of using a hanger 10 with a standard 6 inch or 8 inch cleat, the slot center 29 may be spaced from second edge 22 by a distance 30 of about 0.5 inches. Again, this dimension is provided for exemplary purposes and, as in previous examples, may be varied as desired without departing from the scope of this invention.

As shown in FIG. 4, to attach a line L to hanger 10, line L may be threaded through slot 27 and secured to the hanger 10 such as by knotting, welding, sewing, adhering or other methods commonly used in the art. When using webbing 26, the end 31 of webbing 26 may be threaded through slot 27 and guided back upon itself to form a loop 32, which is held fast by stitching 33 (FIG. 4). As shown, loop 32 may wrap around the first portion 17' of body portion 17 and be made somewhat loose to allow movement of the line L and hanger 10 relative to each other.

With line L secured to hanger 10, the hanger 10 may be used to secure the line L to a cleat C attached to the surface 35 of a dock, boat or other structure. To hang line L from cleat C having a closed eye 14, the hanger 10 is inserted lengthwise into the eye 14 of cleat C, in the direction of the arrow in FIG. 5, and passed through the eye 14. Once the hanger 10 has cleared the far side 36 of the cleat C, it is rotated such that the first edge 18 of hanger 10 generally faces the far side 36 of the cleat C (FIG.6). Then, as best shown in FIG. 6, the first edge 18 and/or wing edges 19 are brought into contact with the sidewalls 15 of eye 14 as by gravity or under tension placed on the line L. With the hanger 10 and cleat C so engaged, the hanger 10 holds the line L fast to the cleat C.

Securement and release of the hanger 10 to cleat C requires simple motions, namely insertion and rotation, which may be performed with one hand. As will be appreciated, knots typically used to secure a line to a cleat C involve more difficult motions that generally require two hands.

In one method for attaching hanger 10 to a cleat C, the hanger 10 is placed lengthwise in the palm of one's hand with the line L held adjacent to a face 37 of the hanger 10 (FIG. 5). The hanger 10 is held near one of the wing portions 16 below body portion 17. (FIG. 4A). So held the hanger 10 is inserted into eye 14 generally in the direction indicated by the arrow I in FIG. 5. When performing this task with one hand, the user may release two fingers or a single finger and thumb to grasp the portion of hanger 10 extending through eye 14 and pull the remainder of the hanger 10 through the eye 14. Alternatively, the user would insert the hanger 10 with one hand and use the other hand to pull the hanger 10 through eye 14 and rotate, the hanger 10 to the position generally shown in FIG. 6, such that, the length 11 of hanger 10 bears upon the side walls 15 of eye 14 preventing the hanger 10 from retracting through the eye 14. As shown in FIG. 6, the swept back shape of edges 19 allows the nose 20 of hanger 10 to seat at least partially within eye 14 aiding in the ability of hanger 10 to resist forces that would tend to move hanger 10 sideways or cause it to rotate to a position where it could retract through eye 14.

To release the hanger 10, the user simply rotates the hanger 10 back to a position similar to that shown in FIG. 5 and passes or drops the hanger 10 lengthwise through eye 14 in a direction opposite arrow I. As will be appreciated, due to the tension on line L, it may be necessary to first pull on the hanger 10 to unseat it from within sidewalls 15 before rotating the hanger 10 to a release/insertion position shown in FIG. 5.

As shown in FIG. 4, when hanger 10 is attached to one end of a line L having a fender F supported on line L , the hanger 10 may be used to hang fender F from a cleat C. As shown in FIG. 7, due to the thickness 13 of hanger 10, a dock line D may be attached the same cleat C to which the hanger 10 is attached. In this way, a fender F and dock line D may be simultaneously attached to a single cleat C.

As shown in FIG. 4, a fender F may be fastened to line L using a buckle assembly 40. As best shown in FIG. 10 buckle assembly 40 has a tab or loop 41 attached to a buckle 42 defining a first slot 43 and a second slot 44 separated by a cross member 45. The line L may be passed upwardly through first slot 43 over cross member 45 and downwardly through second slot 44 and pulled tight to secure the buckle assembly 42 to line L. Buckle 42 is sized larger than an opening 46 on a fender F such that, the user may adjust the length 47 of line L between the cleat C and fender F, or in other words, adjust the vertical position at which the fender F hangs from a boat B or docking structure P. Preferably, buckle assembly 40 is secured to line L such that when drawn against fender F, the loop 41 extends generally outward from the fender F allowing the user to easily grasp the loop 41 and raise the fender F. When the buckle assembly 40 is used in conjunction with the hanger 10 to form a fender hanging assembly (FIG. 4), a user seated within boat B may grasp loop 41 to relieve tension on line L from fender F and with the loop 41 in hand, rotate hanger 10 and drop hanger 10 lengthwise through eye 14 to disengage the hanger 10 from cleat C with the same hand. At this point, since hanger 10 is larger than the opening in the fender F, the user may simply haul up the fender and hanger 10 by loop 41. The single-handed operation leaves the user's other hand free to steady themselves or perform some other function. This operation may be performed, however, with two hands by taking tension off the hanger 10 with one hand and removing the hanger 10 with the other hand.

Thus, it should be evident that the hanger disclosed herein carries out at least one of the various objects of the invention set forth hereinabove and otherwise constitutes an advantageous contribution to the art. As may be apparent to persons skilled in the art, modifications can be made to the preferred embodiments disclosed herein without departing from the spirit of the invention, the scope of the invention being limited solely by the scope of the attached claims.

What is claimed:

1. A hanger for securing a line to a cleat, which has a pair of sidewalls lying in a plane defining an eye therebetween, the hanger comprising:

a body portion having a length greater than the eye and a width less than the eye;

a receiver carried on said body portion, said receiver being adapted to secure the line to said body portion; and a nose extending from said body portion such that, when the hanger is secured, it protrudes into the plane of the sidewalls.

2. The hanger of claim 1, wherein said nose is located centrally on said body portion and adapted to at least partially extend into the eye of said cleat.

3. The hanger of claim 1, wherein said body portion includes a pair of wing portions extending rearward and outward relative to said nose.

4. The hanger of claim 3, wherein said wing portions extend linearly at an acute angle relative to the plane of the sidewalls.

5. The hanger of claim 4, wherein said nose includes a generally planar edge adapted to be insertably received between the sidewalls, when the longitudinal axis of said body portion is oriented generally parallel to the plane of the sidewalls.

6. The hanger of claim 1, wherein said body portion has a thickness adapted to provide a clearance within the eye for the line.

7. The hanger of claim 6, wherein said thickness provides clearance for one or more additional lines within the eye.

8. The hanger of claim 1, wherein said receiver is an opening formed in said body portion adapted to receive at least a portion of the line therethrough.

9. The hanger of claim 8, wherein said opening is in the form of a slot oriented lengthwise on said body portion.

10. The hanger of claim 9, wherein said slot is sized larger than the line, whereby the line may move within said slot.

11. The hanger of claim 1, wherein said receiver is located on said body portion such that it aligns with the eye when said body portion is in an engaged position.

12. A hanger used to fasten a line to a cleat having spaced sidewalls separated by a distance, the line hanger comprising:

a body portion having a length greater than the distance between the sidewalls and a width less than the distance between the sidewalls; and a receiver carried on said body portion adapted to secure the line to said body portion, whereby the hanger is insertable lengthwise between the sidewalls and whereby said length of said body prevents passage of said body through the cleat in a widthwise manner.

13. The hanger of claim 12, wherein said receiver is an opening formed in said body portion.

14. The hanger of claim 13, wherein said opening is larger than the line.

15. The hanger of claim 14, wherein said opening is sized at least about 12% larger than the line.

16. The hanger of claim 13, wherein said opening is in a form of a slot.

17. The hanger of claim 12, further comprising a nose extending outwardly from said body portion along the width of said body portion adapted to protrude beyond a plane connecting points of contact between said body portion and the sidewalls when said body portion is in widthwise contact with the cleat.

18. The hanger of claim 17, wherein said nose protrudes between the side walls.

19. The hanger of claim 18, wherein said nose is centered on said body portion with respect to said sidewalls.

20. The hanger of claim 17, wherein said nose protrudes at least about 12% of the distance.

21. The hanger of claim 17, wherein said body includes wing portions extending rearward of said nose.

22. The hanger of claim 21, wherein said wings extend rearward of said nose at an angle of about 45°.

23. The hanger of claim 12, wherein said length of said body is at least about 125% of the distance.

24. The hanger of claim 12, wherein said length is about 140% of the distance.

25. The hanger of claim 24, wherein said width is about 20% of said length.

26. The hanger of claim 24, wherein said body portion has a thickness of about 10% of said length.

27. The hanger of claim 24 further comprising, a nose formed on said body portion, said nose extending into a plane defined by the sidewalls.

28. The hanger of claim 27, wherein said nose extends into said plane about 10% of said length.

29. The hanger of claim 28, wherein said nose has a nominal lateral dimension of about 36% of said length.

30. A fender hanging assembly used in conjunction with a line and a cleat having sidewalls spaced by a distance, the fender hanging assembly comprising:

a hanger supported on the line on one side of the fender said hanger including a body portion having a length greater than said distance and a width less than said distance, whereby said body portion is insertable between the sidewalls in a lengthwise fashion; and a buckle assembly supported on the line on the other side of the fender relative to said hanger, said buckle assembly including a buckle adapted to prevent the fender from moving farther from said hanger, and a tab extending from said buckle, whereby said tab is graspable to move said fender.

* * * * *